United States Patent [19]

McGill

[11] Patent Number: 4,548,577

[45] Date of Patent: Oct. 22, 1985

[54] LINEAR COMBUSTION APPARATUS FOR ATMOSPHERIC BURNING OF FLARE GASES

[75] Inventor: Eugene C. McGill, Skiatook, Okla.

[73] Assignee: McGill Incorporated, Tulsa, Okla.

[21] Appl. No.: 485,618

[22] Filed: Apr. 18, 1983

[51] Int. Cl.[4] ..... F23D 13/20

[52] U.S. Cl. ..... 431/202; 431/350; 431/5; 431/12; 431/89

[58] Field of Search ..... 431/202, 5, 4, 12, 61, 431/252, 281, 285, 349, 350; 126/110 C, 116 R; 432/222; 239/290, 294, 295, 299, 419, 423; 137/7, 9, 10, 14, 119; 60/749

[56] References Cited

U.S. PATENT DOCUMENTS

| | | | |
|---|---|---|---|
| 2,621,720 | 12/1952 | DuFault | 431/350 |
| 2,644,515 | 7/1953 | Lampert et al. | 431/350 X |
| 3,322,178 | 5/1967 | Nahas | 431/5 X |
| 3,512,911 | 5/1970 | Reed et al. | 431/202 |
| 3,547,567 | 12/1970 | Turpin | 431/202 |
| 3,554,681 | 1/1971 | Proctor | 431/202 |
| 3,732,059 | 5/1973 | Goodnight et al. | 431/350 X |
| 3,749,546 | 7/1973 | Reed et al. | 431/202 X |
| 3,779,689 | 12/1973 | Reed et al. | 431/202 X |
| 3,830,620 | 8/1974 | Martin | 431/350 |
| 3,850,571 | 11/1974 | Zink et al. | 431/349 |
| 3,861,857 | 1/1975 | Straitz | 431/202 |
| 3,914,093 | 10/1975 | Proctor | 431/89 |
| 3,954,385 | 5/1976 | Reed et al. | 431/202 |
| 4,065,248 | 12/1977 | Straitz et al. | 431/202 |
| 4,255,120 | 3/1981 | Straitz | 431/202 |

*Primary Examiner*—Randall L. Green

*Attorney, Agent, or Firm*—Bill D. McCarthy

[57] ABSTRACT

An improved flare gas combustion apparatus comprising a plurality of linear burners connected to plural flare gas conduits, each burner having an elongate tubular member with a plurality of aligned apertures and one of the flare gas conduits connected in fluid communication with the tubular members. A first flare gas conduit is maintained open during operation and the remaining flare gas conduits are selectively and sequentially opened in response to flow indicating devices disposed in a connected flare gas header so that the continuously open flare gas conduit is joined in sequence by the other flare gas conduits as predetermined flow rate values are reached in the flare gas header. For safety purposes a pressure indicating device disposed in the flare gas header is provided to simultaneously open all of the flare gas conduits for flare gas discharge to all of the linear burners when the pressure in the flare gas header reaches a predetermined value.

7 Claims, 8 Drawing Figures

LINEAR COMBUSTION APPARATUS FOR ATMOSPHERIC BURNING OF FLARE GASES

FIELD OF THE INVENTION

The present invention relates to the field of combustion, and more particularly but not by way of limitation, the present invention relates to an improved combustion apparatus for the destruction of flare gases over a wide range of flow rates.

DISCUSSION

There are many facilities, such as refineries and chemical processing plants of various kinds, that must dispose of combustible flare gases in a safe and effective manner. In most cases, local and federal governmental regulations require that the combustion must be complete and smokeless to minimize environmental disturbance. Typically, flare combustion devices, both of the elevated kind and those erected at ground or pit levels, achieve smokeless combustion of hydrocarbons by controlling air and gas velocities, and by the use of smoke suppressants such as steam, directed into the flame.

In a typical prior art device using a fluid smoke suppressant, such as steam or air, the flare tip must deliver the smoke suppressant in adequate quantities to promote rapid mixing in the combustion zone to break up the discharging flare gas and to ensure complete combustion. While generally successful, capacity design continues to be a major concern where the discharging flare gas varies over a wide range of flow rates.

An example of prior art devices which have dealt with the process of combusting flare gases is U.S. Pat. No. 2,779,399 issued to Zink and Reed which teaches the use of a flare stack having a main flare gas tip mounted at its upper end with a sleeve surrounding the upper end to provide an annular space that serves to deliver air and steam into the discharging flare gas flame, and a centrally disposed tubular member that delivers steam spray into the flame. U.S. Pat. No. 3,512,911, also issued to Zink and Reed, teaches a device which uses air and steam directed into the center of the flare tip. Turpin, U.S. Pat. No. 3,547,567, teaches a flare stack combustion tip which breaks up the main gas flow into a plurality of flow segments, and air and steam are directed through a shroud surrounding the flare tip.

Procter, U.S. Pat. No. 3,554,631, teaches a flare stack tip featuring rows of air-inducing devices operating to use the Coanda principle to drive air and steam into the discharging flare gas. Procter's later patent, U.S. Pat. No. 3,914,093, teaches further developments in Coanda devices.

The above listed examples of prior art flare gas combustion, as well as all other such devices known to the present inventor, teach devices which serve to break up the "log mass" of flare gases discharged from flare stacks, and all such devices are constructed of components that are subjected to the intense heat of the combusting flare gas since such components are of necessity in close proximity to the flame. Further, such devices have achieved their respective degree of success at or near design capacity of the system.

Other prior art flare devices have considered the difficulties of operating a flare combustion apparatus over a wide range of flow rates by providing a plurality of staged burners, such as Reed, et al., U.S. Pat. No. 3,749,546. That patent teaches a pit burner having a plurality of horizontally disposed flow lines with upwardly extending risers which support burner nozzles. One flow line has continuous communication with the source of flare gas while the remaining flow lines are sequentially opened for flare gas discharge as the pressure in the connecting manifold increases. Within the design ranges of the flow line capacities, the velocity of the discharging flare gas is generally high enough over a specific flow rate range to attain increased air mixing in the on stream burners. The staging taught by Reed, et al., U.S. Pat. No. 3,749,546 is also used in Reed, et al., U.S. Pat. No. 3,779,689 which illustrates the use of staging on a waste-gas disposal system embodied in a ground level flare stack. Nahas, U.S. Pat. No. 3,322,178, also addressed the problem of burning flare gases smokelessly over 100 percent of the design flaring load.

Even with staging, prior art devices tend to smoke when the pressure drops below several inches of water column pressure. In such cases, even where staged burning is accomplished, the first stage is subject to near infinite turndown. Without enough flow to provide several inches of water column pressure, such devices inevitably produce smoke. Prior art flare tips generally vent the flare gas in a cylindrical profile, and even though ports serve to jet the discharging gas in designated directions, at very low pressures the discharging flare gases simply rise with the flame and create the "log mass" effect mentioned above.

SUMMARY OF INVENTION

The present invention provides an improved combustion apparatus for burning of flare gases over a wide range of flow rates and comprises a flare gas header connected to plural flare gas conduits, each of the flare gas conduits connected to one or more T-shaped burners. Each burner has an inlet portion, or riser, connected to a substantially horinzontally disposed tubular body portion which has a plurality of burner ports aligned along its upper surface. A housing is provided about the burners for substantially containing the flame of the combusting flare gas discharge.

Preferably, each of the burners has a plurality of ignition ports along the sides of its tubular body portion with a tab member supported substantially below each ignition port, the tab members spaced apart to provide air directing channels therebetween. Each tab member is provided with an air passage port extending through it and disposed substantially below the adjacent ignition port. Flame turbulating fluid, such as steam, may be provided as required via a flame turbulating assembly.

Staged sequencing of the burners is achieved by signal actuating valves disposed in each of the flare gas conduits except for the first flare gas conduit which has a valve maintainable in its open position during operation. Each of the signal actuating valves is opened in response to a signal representative of a predetermined flow rate of flare gas through the flare gas header. Flow indicating switches provide opening signals to the signal actuating valves as the flow rate of the flare gas reaches predetermined values. Finally, a pressure indicating assembly provides simultaneous opening of all of the signal actuating valves for maximum discharge of the flare gas when the pressure in the flare gas header reaches a predetermined value.

It is an object of the present invention to provide an improved combustion apparatus that is capable of smokeless flare combustion for flow rates ranging from near zero pressures to full design capacity.

Another object of the present invention is to provide an improved combustion apparatus, while achieving the above stated objects, which is less expensive than prior art devices to fabricate, and which provides long service life, low maintenance and efficient operation.

Other objects, features and advantages of the present invention will become clear from the disclosure provided hereinbelow when read in conjunction with the included drawings and the appended claims.

DESCRIPTION

Figure 1:
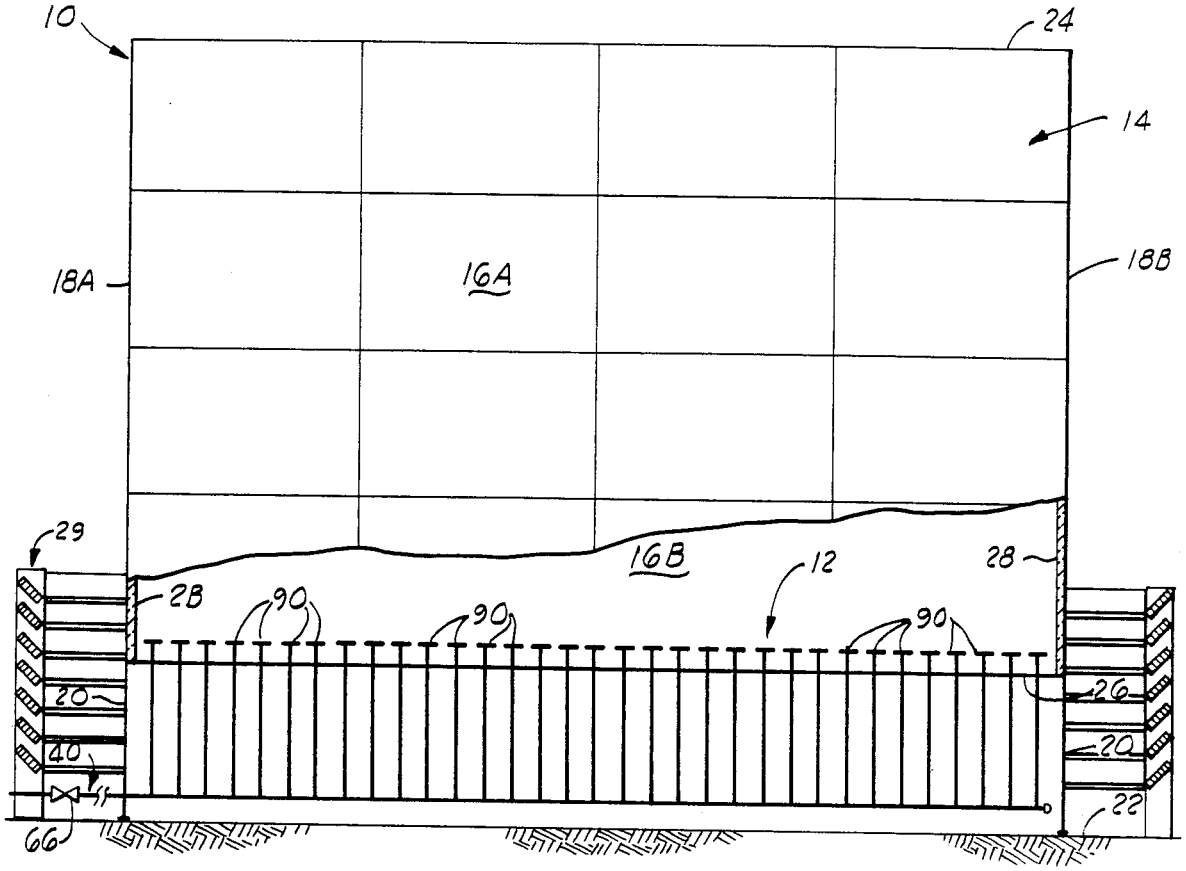
FIG. 1 is a partial cutaway, side elevational view of a linear combustion apparatus constructed in accordance with the present invention, the view of FIG. 1 being a semi-detailed diagram.

Referring to the drawings generally, and specifically to FIG. 1, shown therein is a linear combustion apparatus 10 constructed in accordance with the present invention. To assure clarity, like numerals will be used throughout all of the drawings to designate the same components in the following description.

The linear combustion apparatus 10, sometimes referred to herein as a flare gas combustion assembly, comprises a burner assembly 12 which is supported via appropriate support brackets (not shown) in a housing assembly 14. The housing assembly 14 has a pair of opposing side walls 16A and 16B that are joined to a pair of opposing end walls 18A and 18B, all of which are supported via a plurality of support legs 20 at a predetermined distance of a few feet above the ground level 22. The housing assembly 14 is open at its upper end 24 and at its lower end 26 with the burner nozzles of the burner assembly 12 disposed within the lower end 26. The dimensions of the rectangularly shaped housing assembly 14 will vary with the total capacity of the linear combustion apparatus 10, and should be determined such that the housing assembly 14 substantially contains the flame produced by the combustion of the discharging flare gas. The housing assembly 14 is provided with a refractory liner 28 to protect the inner surfaces thereof.

A barrier 29 is provided around the base of the housing assembly 14 to serve as a wind break and to serve as a radiation shield. (The forward section along the side wall 16A has been omitted in FIG. 1 in order to show the burner assembly 12.) The barrier 29 may be of conventional open slat structure, and since such barriers are common, further description will not be necessary. Of course, it will be understood that the linear combustion apparatus 10 can also be elevated, such as disposed on the top end of a flare stack, in which case the need for a barrier, if provided, presents different design criteria. In any event, such barriers are well known and are considered to be within the knowledge of persons of ordinary skill.

Figure 2:
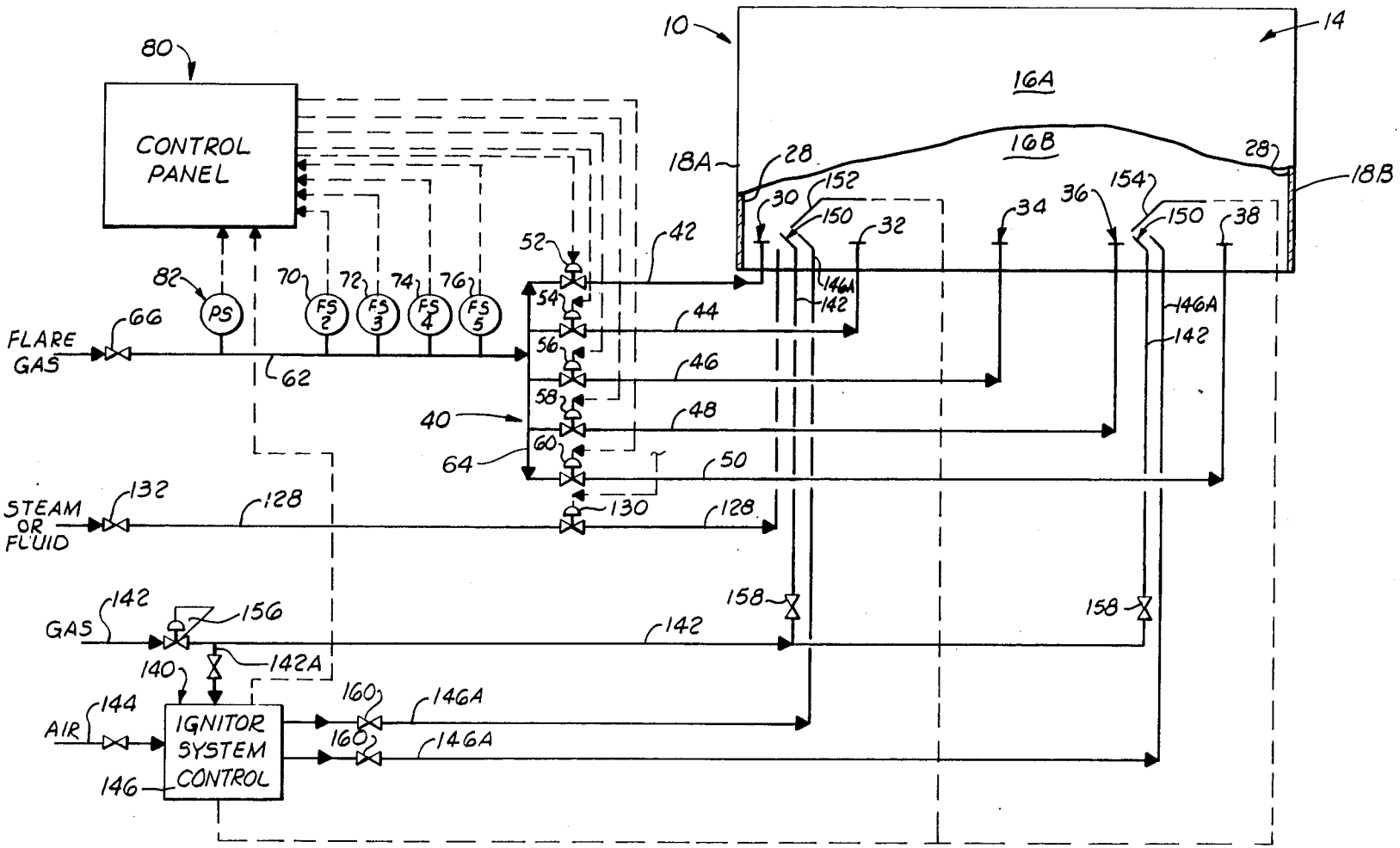
FIG. 2 is a schematical representation of the piping and instrumentation of the combustion apparatus of FIG. 1.

As depicted in FIG. 2, in the illustrated embodiment of the present invention discussed herein, the burner assembly 12 comprises a first stage burner assembly 30, a second stage burner assembly 32, a third stage burner assembly 34, a fourth stage burner assembly 36 and a fifth stage burner assembly 38. The burner assembly 12 also comprises a flare gas header conduit 40 that is connected to a first flare gas conduit 42, a second flare gas conduit 44, a third flare gas conduit 46, a fourth flare gas conduit 48 and a fifth flare gas conduit 50 that connect respectively to the first stage burner assembly 30, the second stage burner assembly 32, the third stage burner assembly 34, the fourth stage burner assembly 36 and the fifth stage burner assembly 38.

Disposed within the first flare gas conduit 42 is an automatic valve 52. The valve 52, during operation of the burner assembly 12, is maintained in its open position, as discussed more fully below. Disposed within the other flare gas conduits are a plurality of signal actuated valves 54, 56, 58, and 60 which control flare gas flow respectively through the second flare gas conduit 44, the third flare gas conduit 46, the fourth flare gas conduit 48 and the fifth flare gas conduit 50. The flare gas header 40 has an inlet leg 62 and a distribution leg 64, the inlet leg 62 being connected to a source of flare gas that is to be destroyed by combustion in the multiple burners of the burner assembly 12. A shut down valve 66 may be provided if desired.

The signal actuated valves are of conventional structure and need not be described further for the purpose of the present disclosure. Each of these signal actuated valves is responsive to one of a plurality of flow switches 70, 72, 74 and 76 that are supported by and in communication with, the flare gas header 40 along its inlet leg 62. These flow switches are of conventional structure, such as, for example, FCI Model FR72-4 flow switches manufactured by Fluid Components, Inc., 1755 LaCosta Meadows Drive, San Marcus, Calif. 92069. These flow switches are set to provide an electrical signal to a control panel 80, which in turn sends the signal via conventional relay devices to the signal actuated valves 54, 56, 58 and 60. The flow switches 70, 72, 74 and 76 are set at different flow rate levels so that their respectively associated signal actuated valves 54, 56, 58, and 60 are opened at predetermined increases in the flare gas flow rate in the flare gas header 40. That is, the flow switch 70 signals the signal actuated valve 54 to open when the flare gas flow rate increases to a first predetermined flow rate value; the flow switch 72 signals the signal actuated valve 56 to open when the flare gas flow rate increases to a second predetermined flow rate value; the flow switch 74 signals the signal actuated valve 58 to open when the flare gas flow rate increases to a third predetermined flow rate value; and the flow switch 76 signals the signal actuated valve 60 to open when the flare gas flow rate increases to a fourth predetermined flow rate value. Conversely, as the flare gas flow rate decreases, the signal actuated valves 54, 56, 58 and 60 are closed in reverse sequence as the flow switches 70, 72, 74 and 76 detect these decreased flare gas flow rate levels. In operation, the valve 52 is retained open so that flare gas is continuously flowing through the first flare gas conduit 42, and this flare gas conduit is joined by the other flare gas conduits as the flare gas flow rate increases.

A safety feature of the present invention is provided by a pressure indicating assembly 82 which is supported in communication with the flare gas header 40 in the inlet leg 62. The pressure indicating assembly 82 comprises a pressure switch of conventional design, such as, for example, Dual Snap Model 646GZE1 Pressure Switch manufactured by Custom Control Sensors, Inc., 21111 Plummer St., Chatsworth, Calif. 91311. The pressure indicating assembly 82 is responsive to pressure in the flare gas header 40, and when the pressure reaches a predetermined value, it sends a signal to the control panel 80 which relays signals to all of the signal actuated valves 54, 56, 58 and 60 to open simultaneously to provide maximum flare gas discharge. Preferrably, the pressure indicating assembly 82 is interconnected in a conventional timer circuit (not shown) that is set to about a thirty second timer count. When the pressure switch signals the control panel 80, the timer circuit relays the aforementioned signals to the signal actuated valves 54, 56, 58 and 60 only during the thirty second timer count. After the timer circuit has timed out, the signals from the control panel 80 effected by the pressure switch are no longer sent to the signal actuated valves, and the signal actuated valves 54, 56, 58 and 60 are again under the control of the flow switches 70, 72, 74 and 76. The pressure indicating assembly 82 is designed to prevent overpressuring within the maximum design capability of the linear combustion apparatus 10 during a selected time period, such as the thirty second timer count; thus the pressure indicating assembly 82 provides for instant relief of the system at peak pressures that occur before the flow switches can react to open the signal actuated valves. Of course, other pressure relief devices of conventional construction may be provided should the maximum discharge rate of a particular unit be insufficient to adequately address potential pressure peaks.

Figure 3:
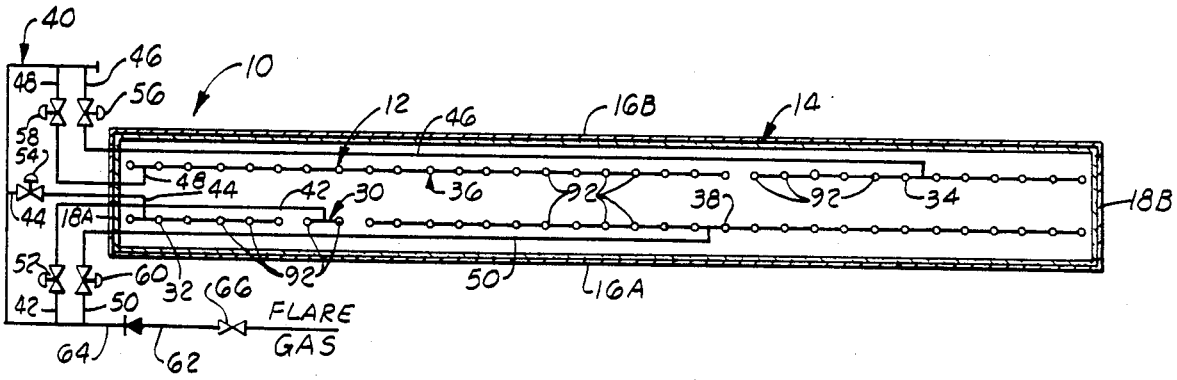
FIG. 3 is a partially complete top plan view of the combustion apparatus of FIG. 1.

As depicted in FIG. 2, the stage burner assemblies 30, 32, 34, 36 and 38 are each represented by one T-shaped burner. This is for drawing simplification, as the plan view of FIG. 3 will disclose. For clarity, the burner nozzles are not shown in this figure so that the flare gas conduits will be clearly visible. As shown, the first stage burner assembly 30 comprises a pair of T-shaped burners, each conforming to the description which will be provided hereinbelow; the second stage burner assembly 32 comprises six burners; the third stage burner assembly 34 comprises twelve burners; the fourth stage burner assembly 36 comprises twenty-one burners; and the fifth stage burner assembly 38 comprises twenty-five burners. As will be understood, the number of stages as well as the number of burners in each stage will be a matter of design choice, as these numbers will be determined by the minimum, intermediate and maximum design capacities required by a particular system, and the determination of such will be clear to persons of ordinary skill in the art.

Figure 4:
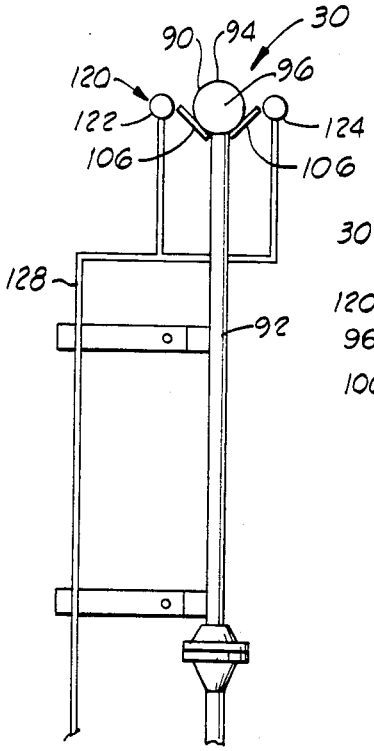
FIG. 4 is an end elevational view of one of the T-shaped burners disclosed herein.
Figure 5:
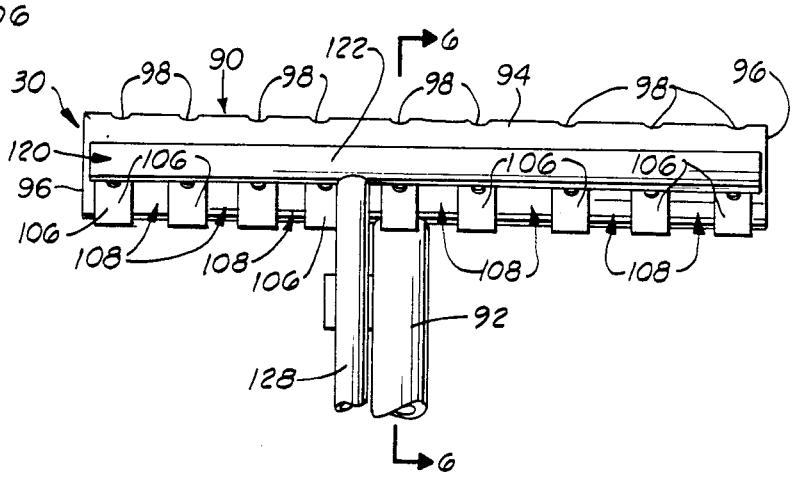
FIG. 5 is a side elevational view of the burner of FIG. 4.

Depicted in FIGS. 4 and 5 is one of the T-shaped burners 90 of the first stage burner assembly 30. With the exception noted below, each of the burners in the above mentioned stage burner assemblies 30, 32, 34, 36 and 38 are of identical construction; therefore the description of the burner 90 shown in FIGS. 4 and 5 will be sufficient for all of the burners. The end elevation of burner 90 is depicted in FIG. 4 while the side elevational view is depicted in FIG. 5. The burner 90 is of substantially T-shaped configuration, having an inlet or riser portion 92 that is connected to the first flare gas conduit 42 (it will be understand that the inlet portions of the other burners connect to the respective flare gas conduits). The inlet portion 92 also has a substantially horizontally disposed tubular body portion 94 which is closed at each of its ends via end plates 96. Along the upper surface of the body portion 94 are a plurality of burner ports 98. The burner ports 98 are most clearly shown in the cross sectional view of the burner 90 depicted in FIG. 6 wherein discharging flare gas from the burner ports 98 is depicted by the arrow 100.

The T-shaped burner 90 also has a plurality of ignition ports 102 along each side of the body portion 94. Flare gas discharge is indicated by the arrows 104. A plurality of tab members 106 are attached, such as by welding, along the lower part of the body portion 94 and extend angularly upwardly as shown. Each of the tab members 106 is disposed below one of the ignition ports 102, and the tab members are spaced apart along the body portion 90 to form air directing channels 108 therebetween. Also, each tab member has an air passage port 110 extending through it, with the air passage port 110 being disposed substantially below its adjacent ignition port 102. The tab members help to increase the turbulence, and thus the mixing, of the air flowing through the air directing channels 108 induced into the combustion of the flare gas discharging from the ignition ports 102 (indicated by the arrows 104); the air passage ports 110 serve to assure adequate combustion air to the discharging flare gas so that instability is avoided at very high flow rates.

Figure 6:
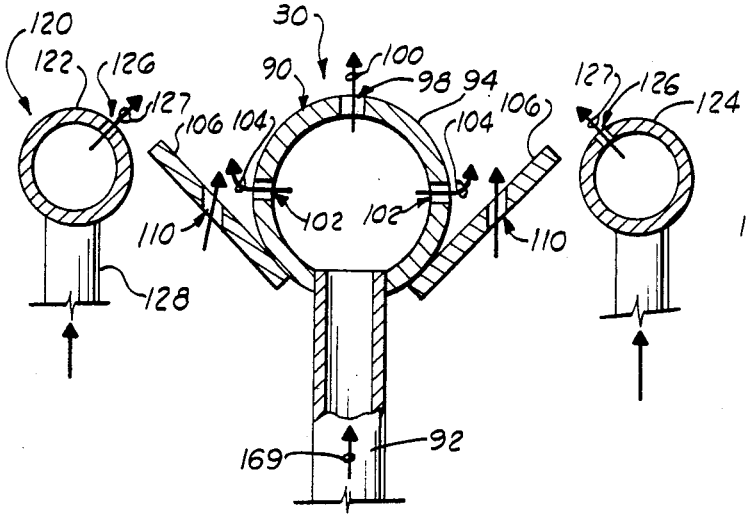
FIG. 6 is a cross sectional view of the burner taken at 6—6 in FIG. 5.

Disposed in close proximity to the burner 90 shown in FIGS. 4 through 6 is a fluid turbulating assembly 120, which, in the preferred embodiment, is provided alongside only the burners 90 of the first stage burner assembly 30. That is, the burners 90 of the other burner assemblies 32,34, 36 and 38, are not provided with fluid turbulating assemblies 120. As shown, the fluid turbulating assembly 120 has a pair of discharge conduits 122, 124 spatially disposed along opposing sides of the body portion 94 of the burner 90. Each of the discharge conduits 122, 124 has a plurality of fluid discharge ports 126 formed therein and directioned (as indicated by the arrows 127) so as to cause a smoke suppressant fluid such as steam to be jetted into mixing contact with the flame produced by the combustion of the flare gas discharge. The discharge conduits 122, 124 are connected to a fluid delivery conduit 128 as shown in FIG. 2.

The fluid selected for dispersal via the fluid turbulating assembly 12 will vary with a particular installation, and further, one or more of the burners of the other burner assemblies 32,34,36 and 38 can be provided fluid turbulating assemblies 120 as required. If a smoke suppressant is desired, steam is the most likely choice. In such cases, the fluid delivery conduits 128 are connected to an appropriate source of steam, and steam control valves 130 of conventional structure may be provided, as well as a shutdown valve 132 as required for a particular installation. Instead of steam, it will be appreciated that other pressurized fluids could be used to turbulate the flame of the burning flare gas; in fact, it may be desirable to connect the fluid delivery conduits 128 to a fuel source, such as natural gas, which will both turbulate the flame and provide additional fuel to the flame of the burning flare gas. In yet other cases, it may be desirable to disperse flare gas, such as from another source of waste gas. In such cases, the fluid delivery conduits 128 are simply connected to the flare gas source and disperse the fluid in the same manner as for steam and natural gas. It should be noted that the conduit 128 is not shown in the plan view of FIG. 3, nor has an attempt been made to show other conduits in complete detail since they are conventionally provided in flare type devices and further description is not believed necessary in understanding the present disclosure.

Figure 7:
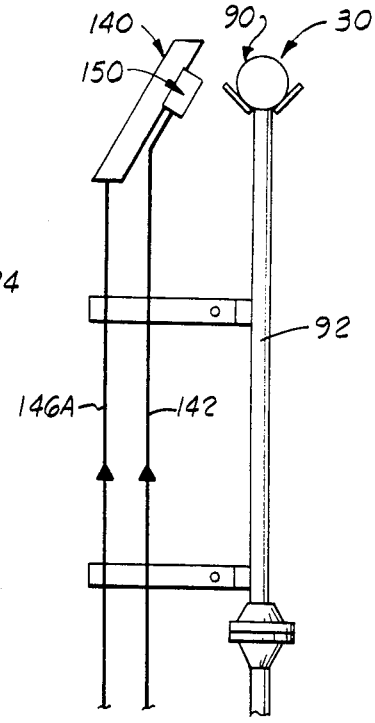
FIG. 7 is an end elevational view of one of the T-shaped burners showing an igniter.

Returning to FIG. 2, the linear combustion apparatus 10 further comprises an igniter assembly 140 which may be provided to initially light the pilots for the burners 90. A conduit 142 is connected to a source of ignition gas, and air is provided via a conduit 144 to a conventional igniter system control 146 which receives a portion of the ignition gas via conduit 142A, combines it in burning proportions with air, and ignites the mixture. Conduits 146A provide a controlled path for the flame front of the ignited mixture to travel to the T-shaped burners 90 where the conduits 142 provide a continuing fuel source to serve as pilots 150 at selected points of the burner assembly 12. Thermal couples 152 and 154 are supported near the pilot ends of the conduits 142 to signal the ignitor system control 146 to cut off the flame front impulses traveling through the conduits 146A once the pilots are burning. The thermal couple signal to the ignitor system control 146 is also relayed to the automatic valve 52 so that valve 52 is opened only when the pilots 150 are burning; and should the thermal couples cool, signaling no flame at the pilots 150, the valve 52 is closed to prevent unburned flare gas from being discharged. FIG. 7 depicts one of the pilots 150 and illustrates its proximity to the burner 90. As required, conventional valving, such as the pressure regulator valve 156 and valves 158 in the conduit 142, and full ported valves 160 in the conduits 146A, may be provided.

The operation of the linear combustion apparatus 10 has been discussed above as the embodiment illustrated in the drawings has been described. Accordingly, further description of the operation of the present invention is not believed to be necessary as such will be clear to persons of ordinary skill in the art of the present disclosure. However, it may be helpful to add somewhat more description to that which has been provided for the T-shaped burner 90 shown in FIGS. 4 through 6. While not fully understood, it is believed that the unusual and surprising turndown capability achieved by the T-shaped burners 90 is provided by the combination of spreading the flare gas into substantially sheets of gas discharging the burner ports 98 while providing stabilized burning via the ignition ports 102. As depicted in FIG. 6, flare gas passing through the inlet portion 92 (depicted by arrow 169) enters the tubular body portion 94 and discharges therefrom via the burner ports 98 and the smaller ignition ports 102. As ignition occurs, the flame of the discharging flare gas from the burner ports 98 is further joined by the flame of the discharging flare gas from the ignition ports 102, thus helping to stabilize the flame above the body portion 94. The tab portions 106 help to increase the turbulence of induced air through the air directing channels 108, resulting in upwardly moving flame even in extreme pressure turndown situations. Of course, at very low flow rates, only the burners of the first stage burner assembly 30 are on stream, and as higher flow rates are encountered, the on stream burners are increased as more stages are brought in, thereby effecting a stable, smokeless flame over a wide range of flare gas flow rates. As necessary, the fluid turbulating assemblies 120 are utilized to jet a smoke suppressant, additional fuel gases, or additional flare gases into the flame of the first stage burner assembly 30 (and other burner assemblies are required). Results have proven that the invention as described herein is a highly effective and efficient combustion apparatus for the destruction of a wide range of hydrocarbon flare gases.

Figure 8:
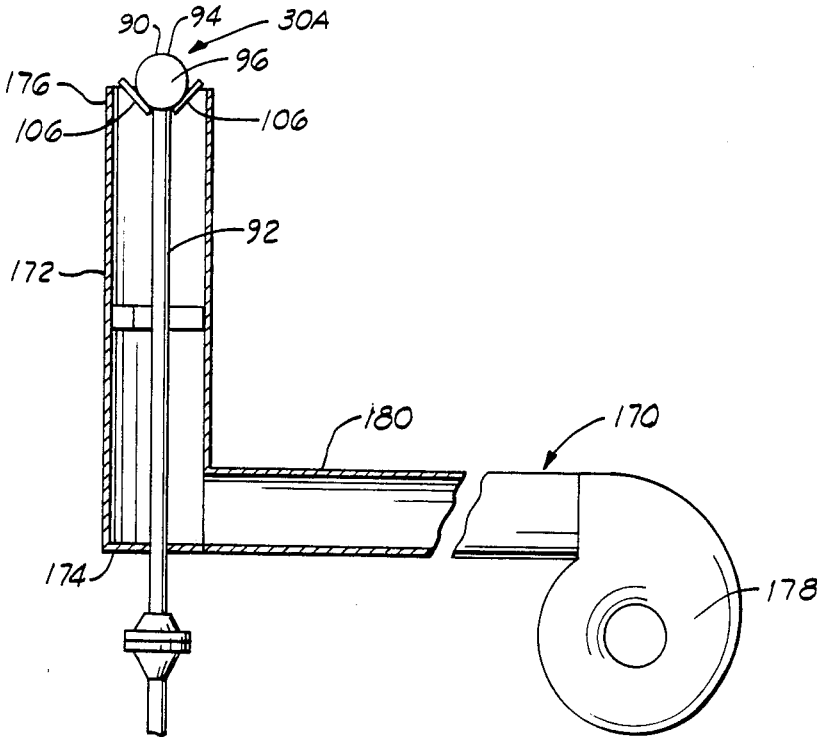
FIG. 8 is an end elevational view of a T-shaped burner of similar construction to that shown in FIG. 4 except having an air blower associated therewith, the air blower assembly shown in partial cutaway view.

Shown in FIG. 8 is a burner assembly 30A, so designated because it is a variation to the structure of the first stage burner assembly 30 depicted in FIG. 4 and described hereinabove. The burner assembly 30A comprises an air blower assembly 170 which is disposed in air delivery relationship to the burners 90. Since a description of the structure of burner 90 has been provided, it will be sufficient to point out that FIG. 8 shows one of these burners without modification. The air blower assembly 170 has an upwardly extending air duct portion 172 that is a substantially box shaped housing with a sealed lower end 174 and an open upper end 176. The riser 92 extends through an appropriately sized opening in the lower end 174, and the tubular body portion 94 is disposed at the opening of the upper end 176 of the air duct portion 172 as shown, with the width of the opening of the upper end 176 being determined such that the walls of the air duct portion 172 are in close proximity to the tab members 106, and preferably, the length (not shown) of the air duct portion 172 being determined such that the in line burners 90 substantially fill the length of the opening of the upper end 176.

The air blower assembly 170 also comprises a powered blower 178, driven by a motor (not shown), that is preferably located outside of the barrier 29 and appropriately supported by a structure (not shown). A conduit 180 is connected to the outlet port of the blower 178 and to an inlet port of the air duct portion 172 such that air is caused to be blown by the blower 178 through the air duct portion to pass upwardly substantially through the air directing channels 108 formed between the tab members 106. In operation this pressurized air flow serves as combustion air for the dischargining flare gas, as well as serving to provide turbulation to the flame produced thereby. In other aspects, the operation of the burner assembly 30A will be in substantial conformity to that described hereinabove for the burner assembly 30.

It is clear that the present invention is well adapted to carry out the objects and to attain the ends and advantages mentioned as well as those inherent therein. While a presently preferred embodiment of the invention has been described for purposes of this disclosure, it will be recognized that numerous changes may be made which will readily suggest themselves to those skilled in the art and which are encompassed within the spirit of the invention disclosed and as defined in the appended claims.

What is claimed is:

1. A linear combustion apparatus for burning flare gas over a widely varying flow rate, the combustion apparatus comprising:

a flare gas header conduit connectable to a source of flare gas;

a plurality of flare gas conduits, each of the flare gas conduits having a first end, each of the flare gas conduits connected to the flare gas header conduit at its respective first end;

a plurality of burner assemblies, each burner assembly having at least one T-shaped burner, an inlet portion and a substantially horizontally disposed tubular body portion, the inlet portion of each of the burners connected to one of the flare gas conduits, the body portion having a plurality of burner ports aligned along an upper surface thereof, each burner characterized as having a plurality of ignition ports along each side of the tubular body portion and having a plurality of spaced apart tab members supported by the body portion, one each of the tab members disposed substantially below a corresponding one of the ignition ports and each tab member having an air passage port extending therethrough and disposed substantially below and aligned with the adjacent ignition port, the spaced apart tab members forming air directing channels between adjacent tab members so that air flowing through the air directing channels is induced into the combustion of discharging flare gas and for turbulating the mixture of said air and flare gas; and housing means disposed about the burners for substantially containing the flame created by the combustion of flare gas discharged from the burners, the housing characterized as having a substantially open lower end and an open upper end.

2. The linear combustion apparatus of claim 1 further comprising:

valve means disposed in medial portions of the flare gas conduits for controlling the flow of the flare gas through the flare gas conduits, the valve means comprising a valve disposed in the first one of the flare gas conduits selectively maintainable in an open position during operation of the linear combustion apparatus, the valve means further comprising signal actuating valves disposed in each of the other flare gas conduits, each of the signal actuating valves being actuatable to an open flow position in response to a signal representative of a predetermined flow rate of flare gas through the flare gas header conduit; and a plurality of flow indicating means communicating with the flare gas header conduit for providing signals indicative of the flow rate of the flare gas through the flare gas header conduit, each one of the flow indicating means operably connected to provide a flow rate signal to one of the signal actuated valves in the flare gas conduits so that when the flow rate of the flare gas through the flare gas header conduit reaches predetermined flow rate values the flare gas indicating means selectively and sequentially actuates the signal actuate valves for discharging flare gas through the flare gas conduits and the T-shaped burners in fluid communication with the flare gas conduits containing the signal actuated valves being actuated.

3. A linear combustion apparatus of claim 2 further comprising:

pressure indicating means communicating with the flare gas header conduit for indicating the pressure of the flare gas in the flare gas header conduit and providing signals to the signal actuated valves in the flare gas conduits when the pressure reaches a predetermined valve to open all of the signal actuated valves so that flare gas is discharged from all of the T-shaped burners.

4. The linear combustion apparatus of claim 2 further comprising:

flame turbulating means for directing a selected fluid into mixing contact with the flame created by the combustion of the flare gas, the flame turbulating means comprising at least one discharge conduit spatially disposed along one side of at least one of the tubular body members of the burners, the discharge conduit having a plurality of fluid discharge ports formed therein.

5. The linear combustion apparatus of claim 4 wherein the flame turbulating means comprises:

at least one discharge conduit spatially disposed along one side of the substantially normally disposed upper body portion of each of the T-shaped burners in at least the burner assemblies connected the first flare gas conduit, each of the discharge conduits having a plurality of apertures formed therein, the apertures aligned generally parallel to the alignment direction of the burner ports disposed along the upper surface of the adjacent T-shaped burner.

6. The linear combustion apparatus of claim 2 or 3 further comprising:

igniter means disposed in proximity to at least one of the T-shaped burners for igniting the discharging flare gas.

7. The linear combustion apparatus of claim 1 comprising:

air blower means for directing pressurized air flowing upwardly by the T-shaped burners.

* * * * *

UNITED STATES PATENT AND TRADEMARK OFFICE

CERTIFICATE OF CORRECTION

PATENT NO. : 4,548,577

DATED : October 22, 1985

INVENTOR(S) : Eugene C. McGill

It is certified that error appears in the above-identified patent and that said Letters Patent is hereby corrected as shown below:

In Column 6, line 4, the word "understand" should read --understood--; in column 8, line 43, the word "dischargining" should read --discharging--; in column 9, line 2, the line "having at least one T-shaped burner, an inlet por-" should read --having at least one T-shaped burner comprising an inlet por- --.

Signed and Sealed this

*Twelfth* Day of *August 1986*

[SEAL]

*Attest:*

DONALD J. QUIGG

*Attesting Officer*

*Commissioner of Patents and Trademarks*